US005577714A

United States Patent [19]

Venegas, Jr.

[11] Patent Number: 5,577,714

[45] Date of Patent: Nov. 26, 1996

[54] KNOCK DOWN GUARD RAIL ASSEMBLY AND METHOD FOR ASSEMBLING SAME

[76] Inventor: Frank Venegas, Jr., 4165 Homestead, Howell, Mich. 48843

[21] Appl. No.: 411,422

[22] Filed: Mar. 27, 1995

[51] Int. Cl.[6] ..... E04H 17/14

[52] U.S. Cl. ..... 256/65; 256/19; 256/66; 256/69

[58] Field of Search ..... 256/69, 68, 66, 256/65, 59, 19, DIG. 5, 60, 27, 24

[56] References Cited

U.S. PATENT DOCUMENTS

| | | | |
|---|---|---|---|
| 1,918,607 | 7/1933 | Lindh | 256/65 X |
| 2,557,002 | 6/1951 | Lathrop | 256/65 |
| 3,462,126 | 8/1969 | Demanega | 256/65 |
| 3,921,960 | 11/1975 | Bright | 256/65 |
| 5,261,647 | 11/1993 | Venegas et al. | 256/66 X |
| 5,288,058 | 2/1994 | Russell | 256/69 |
| 5,312,089 | 5/1994 | Venegas | 256/65 |
| 5,370,368 | 12/1994 | Terrels et al. | 256/66 X |

*Primary Examiner*—Anthony Knight

*Attorney, Agent, or Firm*—Gifford, Krass, Groh, Sprinkle, Patmore, Anderson & Citkowski, P.C.

[57] ABSTRACT

The invention is a knock down guard rail assembly and method for assembling the rail. The guard rail has the capacity to be assembled and disassembled for reconfiguration as required by the user. The fastening system used to assemble the rail consists of a removable plate and fastener. The fastening system provides for any amount of rails to be assembled at any angle to create any configuration. The assembly may also be provided with polymerized sheathing extending about the exterior of the rail assembly. The sheathing protects the assembly from the environment and may be provided in any color or support advertisements where desired.

12 Claims, 1 Drawing Sheet

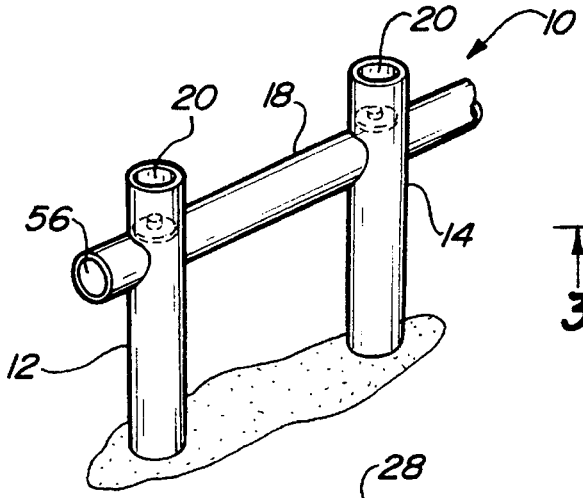
Fig - 1
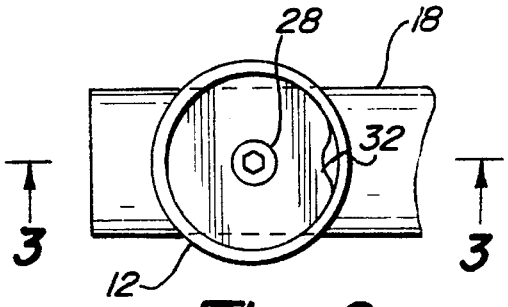
Fig - 2
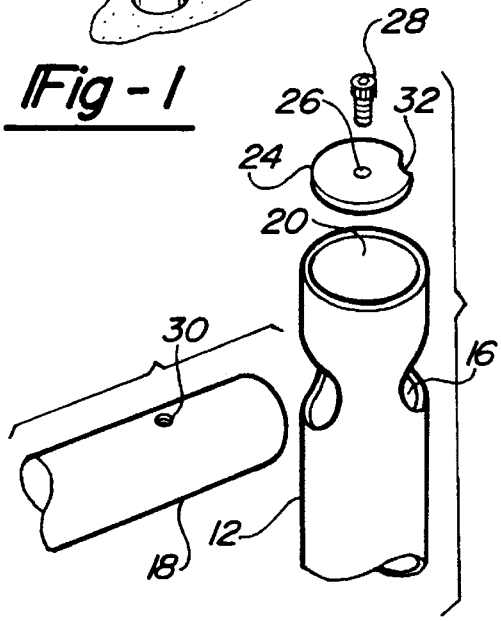
Fig - 4
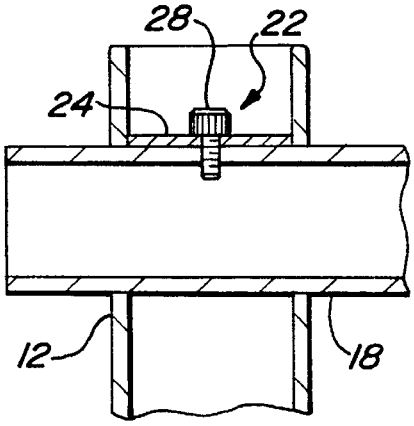
Fig - 3
Fig - 6
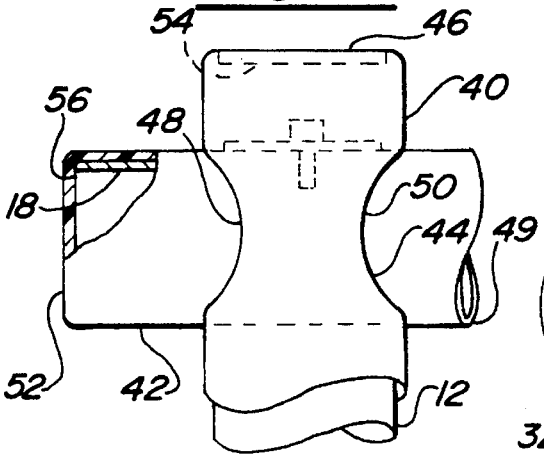
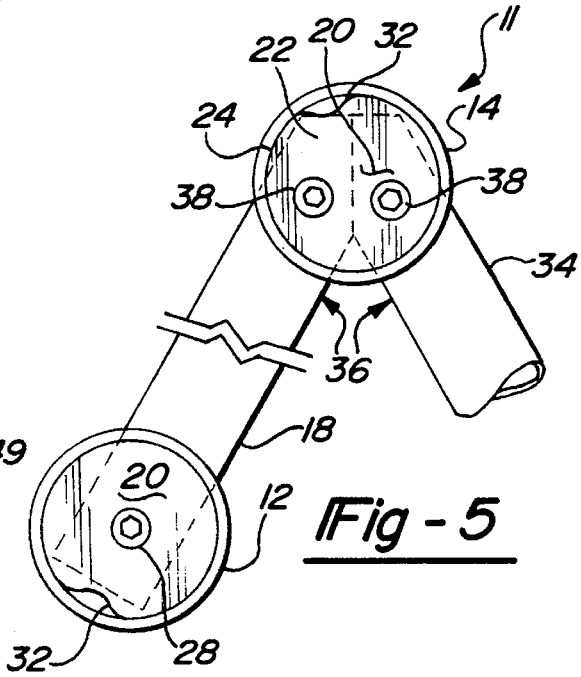
Fig - 5

KNOCK DOWN GUARD RAIL ASSEMBLY AND METHOD FOR ASSEMBLING SAME

BACKGROUND OF THE INVENTION

I. Field of the Invention

The present invention relates to a knock down guard rail assembly. More specifically, the present invention relates to a knock down guard rail assembly that provides the ability for the horizontal rails of the guard rail to be placed at any angle within the vertical support stanchions. The invention also relates to a method for readily engaging the rail within the support stanchion and readily demounting the rail from within the stanchion.

II. Description of the Relevant Art

Previously known guard rail assemblies normally consisted of a permanent structure embedded in concrete or the like. A disadvantage of these guard rail structures is that the guard rail is a permanent fixture that cannot be removed without extensive damage to the surrounding area.

A further disadvantage of previously known guard rail assemblies is that, once assembled, the profile of the structure cannot be disassembled and rearranged to reflect current changes in the usage of the guard rail assembly. A still further disadvantage of these guard rail assemblies is that the vertical support stanchion of the guard rail cannot support a multiplicity of rails extending from the stanchion at any angle without having to fixedly attach the rail to the stanchion.

A still further disadvantage of these previously known guard rail assemblies is that any damage done to the surface of the guard rail assembly by the environment or a vehicle colliding with the guard rail necessitates having to replace or repaint the guard rail assembly on a regular basis.

SUMMARY OF THE PRESENT INVENTION

The present invention provides a guard rail assembly and method for assembling and demounting the assembly which overcomes the disadvantages of previously known guard rail assemblies.

The guard rail assembly of the present invention is a knock down guard rail assembly having the capacity to be readily assembled and disassembled by a single user.

Unlike the previously known guard rail assemblies, the present invention provides a fastening system consisting of a plate and a fastener which allows the rails of the guard rail assembly to be supported within the vertical stanchion at any angle. The knock down guard rail assembly can, therefore, be assembled in any configuration desired by the user.

The knock down guard rail assembly of the present invention may also be easily disassembled and reassembled to create a new configuration. The plate of the fastening assembly consists of a notch that readily accommodates the same tool used for removing the fastener from the plate. Therefore, once the fasteners are removed from the plate, the user can insert the tool within the notch of the plate and readily remove the plate from the interior of the vertical stanchion.

A still further advantage of the knock down guard rail assembly of the present invention is that the vertical support stanchion and rails of the assembly may be sheathed with a removable polymerized material that will protect the assembly from any environmental or vehicular damage. The polymerized sheath may be created in any color and may support advertising if desired.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which:

FIG. 1 is a perspective view illustrating a preferred embodiment of the present invention;

FIG. 2 is a top view illustrating a preferred embodiment of the engaging and demounting assembly of the present invention;

FIG. 3 is a cross sectional view of FIG. 2;

FIG. 4 is a partial perspective and exploded view of the present invention;

FIG. 5 is a top view illustrating a second preferred embodiment of the present invention; and FIG. 6 is a side view illustrating a third preferred embodiment of the present invention.

DETAILED DESCRIPTION OF THE PREFERRED EMBODIMENTS OF THE PRESENT INVENTION

With reference first to FIG. 1, a knock down guard rail assembly 10 of the present invention is thereshown having a vertical support stanchion 12 and second vertical support stanchion 14.

Each vertical stanchion 12, 14 may be provided with an opening 16 for supporting a horizontal rail 18. As shown in FIG. 1, a knock down guard rail assembly 10 is assembled in a standard guard rail configuration. Guard rail assembly 10 of the present invention, however, differs from previously known guard rail assemblies in that vertical support stanchions 12, 14 include top opening 20. Opening 20 provides for access to easy engagement and disengagement of rail 18 from vertical stanchions 12, 14.

With reference now to FIGS. 2, 3 and 4, a preferred embodiment of the engaging and demounting means of the present invention is thereshown. Engaging means 22 preferably consists of plate 24 having an opening 26 for supporting fastener 28. Opening 26 in plate 24 corresponds to an opening 30 provided in rail 18 as best shown in FIG. 4.

To assemble the knock down guard rail assembly 10, rail 18 is slid with an opening 16 of vertical support stanchion 12. Plate 24 is dropped into top opening 20 of vertical stanchion 12. Opening 26 of plate 24 is then aligned with opening 30 on rail 18 and fastener 28 is used to releasably connect engaging assembly 22 with rail 18.

To demount rail 18 from vertical support stanchion 12, fastener 28 is removed from openings 26, 30. Any instrument, preferably the tool used to release fastener 28, may be inserted into notch 32 located on plate 24 to readily remove plate 24 from its position within vertical support stanchion 12. Thus, the knock down guard rail assembly 10 can be readily assembled and demounted to provide several structural configurations as desired.

With reference now to FIG. 5, the second preferred embodiment of the present invention is thereshown. Vertical support stanchions 12, 14 are provided with openings for supporting rails 18 and 34. The advantage of this knock down guard rail assembly 11 is that rails 18 and 34 may be engagingly assembled within vertical support stanchions 12, 14 at equal angles 36 or disparate angles, if preferred by the user.

Engaging means 22 consists of plate 24 and a multiplicity of fasteners 38 for engaging each rail 18, 34 within vertical support stanchion 14. Plate 24 and fasteners 38 provide for easy engagement of a multiplicity of rails within a vertical support stanchion 14 at any desirable angle to vertical stanchion 14 by simply providing opening 26 to properly correspond with an opening in rails 18, 34. Fasteners 38 can then readily engage plate 24 with rails 18, 34 at any angle within the vertical support stanchion 14.

To demount the rail assembly shown in FIG. 5, notch 32 is again provided within plate 24. Again, any utensil or tool may be used to release plate 24 from its position within vertical support stanchion 14 by reaching through top opening 20 and engaging notch 32 after fasteners 38 have been removed.

With reference now to FIG. 6, a third preferred embodiment of the invention is thereshown and provides a polymerized sheath 38 extending about the exterior of vertical support stanchion 12. A second polymerized sheath 40 may also be provided to extend about the exterior of rail 18. The polymerized sheath provides protection from the environment or any vehicular damage. The polymerized sheath may also be provided in a multiplicity of colors and support any form of advertisement on the exterior to coordinate with the end user's utilization of the knock down guard rail assembly.

When assembling the knock down guard rail assembly 10 of the present invention utilizing the polymerized sheath 40, 42, sheath 40 is provided with an opening 44. Opening 44 aligns with opening 16 in vertical support stanchion 12. Sheath 40 is also provided with a top opening 46 that corresponds to top opening 20 of vertical support stanchion 12. Sheath 42 extends about rail 18 and preferably ends at 48 where rail 18 meets vertical support stanchion 12. Sheath 42 then continues at point 50 beyond vertical support stanchion 12. Polymerized caps 52, 54 may also be provided therewith to cover openings 46 and 56 (FIGS. 1, 6) within vertical support stanchion 12 and rail 18, respectively.

To assemble and engage rail 18 to vertical support stanchion 12, polymerized sheath 40 is placed over vertical support stanchion 12 and opening 44 is aligned with opening 16 of vertical support stanchion 12. Polymerized sheath 42 is then slid over rail 18. Rail 18 is then slid within vertical support stanchion 12 until opening 30 is located in the desired position. A second polymerized sheath 49 is then slid onto rail 18 and butts against vertical support stanchion 12 at 50. Engaging means 22 is then utilized to demountably support rail 18 within vertical support stanchion 12 as described above. Demounting of the knock down guard rail assembly having polymerized sheaths is identical to the method described above but includes the extra steps of removing the sheaths from the vertical support stanchion 12 and rail 18, respectively.

Having described my invention, however, many modifications thereto will become apparent to those skilled in the art to which it pertains without deviation from the spirit of the invention as defined by the scope of the appended claims.

I claim:

1. A knock down guard rail assembly comprising:

a stanchion;

a first rail extending within said stanchion;

a second rail extending within said stanchion at an angle disparate to said first rail;

means for engaging said first and second rails in said stanchion; and means for demounting said rail from within said stanchion;

said engaging means comprising a plate receivable within said stanchion and fasteners that correspond in number to the number of rails, said fasteners engageable by said plate.

2. The knock down guard rail assembly defined in claim 1, said engaging means further comprising means for angularly positioning said rail within said stanchion at said disparate angle; said plate having means for fastening said rail within said stanchion at said angular position.

3. The knock down guard rail assembly defined in claim 1, said fasteners further comprising bolts.

4. The knock down guard rail assembly defined in claim 1, said demounting means further comprising a slot in said plate.

5. The knock down guard rail assembly defined in claim 1, said stanchion further comprising a polymerized sheath extending about the exterior of said stanchion.

6. The knock down guard rail assembly defined in claim 1, said rail further comprising a polymerized sheath extending about the exterior of said rail.

7. A method for assembling and demounting a knock down guard rail comprising the steps of:

placing a stanchion in an upright position;

inserting a first rail at a first angle within said stanchion;

inserting a second rail within said stanchion at an angle disparate from said first angle;

attaching said first rail to said second rail within said stanchion; through the use of a plate receivable within said stanchion and fasteners that correspond in number to the number of rails, said fasteners engageable by said plate for fastening each of said first and second rails to said plate.

8. The assembling method of claim 7 further comprising the steps of:

demounting said rail from within said stanchion after assembling said guard rail by unfastening said fastener from said plate and removing said plate from within said stanchion.

9. The assembling method of claim 8, said fastener further comprising a bolt.

10. The assembling method of claim 8, the plate further comprising a slot in said plate for demounting said plate from within said stanchion.

11. The method of claim 7, wherein said stanchion further comprises a polymerized sheath extending about the exterior of said stanchion.

12. The method of claim 7, wherein said rail further comprises a polymerized sheath extending about the exterior of said rail.

* * * * *